US007997923B1

(12) United States Patent
Oh et al.

(10) Patent No.: US 7,997,923 B1
(45) Date of Patent: Aug. 16, 2011

(54) CABLE ORGANIZER FOR A CONNECTOR ASSEMBLY

(75) Inventors: Lawrence Se-Jun Oh, Hummelstown, PA (US); William H. Bernhart, Elizabethtown, PA (US); Robert Flaig, Lancaster, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/792,315

(22) Filed: Jun. 2, 2010

(51) Int. Cl.
*H01R 13/56* (2006.01)

(52) U.S. Cl. ..... 439/446; 439/589; 439/445; 439/470

(58) Field of Classification Search ..... 439/272, 439/460, 445, 589, 470
See application file for complete search history.

(56) References Cited

U.S. PATENT DOCUMENTS

| | | | | |
|---|---|---|---|---|
| 4,857,015 | A | 8/1989 | Michaels et al. | |
| 5,599,202 | A | 2/1997 | Key | |
| 5,742,982 | A | 4/1998 | Dodd et al. | |
| 6,475,021 | B1 * | 11/2002 | Tan et al. | 439/446 |
| 6,986,683 | B2 * | 1/2006 | Lazaro, Jr. | 439/607.18 |
| 7,440,667 | B2 * | 10/2008 | Mullaney et al. | 385/135 |
| 2004/0180569 | A1 | 9/2004 | Chiou et al. | |
| 2007/0037437 | A1 | 2/2007 | Wu | |
| 2007/0246613 | A1 | 10/2007 | Kennedy | |

* cited by examiner

*Primary Examiner* — Briggitte R Hammond

(57) ABSTRACT

A connector assembly includes a housing, a grommet, and a cable organizer. The housing includes an interior chamber. The grommet is disposed in the interior chamber of the housing and extends between a forward end and an opposite exit end. The grommet includes openings extending through the grommet with insulated conductors extending through the openings and joined with contacts such that the contacts project from the forward end. The cable organizer is disposed proximate to the grommet and includes channels extending through the cable organizer with the cables extending through the channels. The cable organizer limits bending by the cables at the exit end of the grommet.

20 Claims, 7 Drawing Sheets

CABLE ORGANIZER FOR A CONNECTOR ASSEMBLY

BACKGROUND OF THE INVENTION

The subject matter herein relates generally to electrical connectors.

Some known connectors include cables coupled with an articulating housing. The cables hold several insulated conductors, or wires. The conductors are joined with contacts or terminals located in the housing. The housing mates with another connector having contacts to electrically couple the contacts in the two connectors. The housing articulates about a pivot axis. For example, the housing may pivot such that the housing includes a bend or angle between an end of the housing that mates with another connector and an opposite end of the housing through which the cable extends. Such connectors may be referred to as swing arm connectors.

The insulated conductors in the cables may extend through a grommet within the housing of the swing arm connectors. The grommet may include openings that individually receive the insulated conductors. Some grommets provide seals about the insulated conductors to prevent passage of contaminants through the grommet. For example, a grommet may engage and seal the insulated conductors around the peripheries of insulating jackets of the conductors. The seals between the grommet and the insulating conductors may prevent moisture from passing between the grommet and the insulating conductors and through the grommet. Such moisture can reach the contacts in the connector and may damage the contacts.

With the articulation of the housing in some swing arm connectors, the bend or angle in the housing may pull the insulated conductors in the cable at an angle with respect to the openings in the grommet. For example, the insulated conductors may be pulled in angled directions away from center axes of the openings in the grommet when the housing bends or articulates. The pulling of the insulated conductors may cause the insulated conductors to bend at or near the end of the grommet through which the insulated conductors exit. The bending of the insulated conductors may break or compromise the seals between the grommet and the insulated conductors and introduce leak paths between the grommet and the insulated conductors. Contaminants such as moisture may pass through the grommet openings by way of the leak paths.

A need exists for an articulating connector or connector that includes a bend that maintains seals between a grommet and insulated conductors extending through the connector.

BRIEF DESCRIPTION OF THE INVENTION

In one embodiment, a connector assembly is provided. The connector assembly includes a housing, a grommet, and a cable organizer. The housing includes an interior chamber. The grommet is disposed in the interior chamber of the housing and extends between a forward end and an opposite exit end. The grommet includes openings extending through the grommet with insulated conductors extending through the openings and joined with contacts such that the contacts project from the forward end. The cable organizer is disposed proximate to the grommet and includes channels extending through the cable organizer with the cables extending through the channels. The cable organizer limits bending by the cables at the exit end of the grommet.

In one embodiment, a connector assembly is provided. The connector assembly includes a housing, a grommet, and a cable organizer. The housing includes an interior chamber. The grommet is disposed in the interior chamber of the housing and extends between a forward end and an opposite exit end. The grommet includes openings extending through the grommet with insulated conductors extending through the openings and joined with contacts such that the contacts project from the forward end. The cable organizer is disposed proximate to the grommet and includes first and second cable separator bodies each having elongated beams. The beams are elongated in different directions to form channels extending through the cable organizer with the insulated conductors extending through the channels. The cable organizer limits bending by the insulated conductors at the exit end of the grommet.

In one embodiment, a connector assembly is provided. The connector assembly includes a housing, a grommet, and a cable organizer. The housing includes an interior chamber. The grommet is disposed in the interior chamber of the housing and extends between a forward end and an opposite exit end. The grommet includes openings extending through the grommet with insulated conductors extending through the openings and joined with contacts such that the contacts project from the forward end. The cable organizer is disposed proximate to the grommet and includes a plurality of cable separator bodies that include recesses disposed on outer sides of the cable separator bodies. The cable separator bodies receive the insulated conductors in the recesses of neighboring cable separator bodies and limit bending by the insulated conductors at the exit end of the grommet.

DETAILED DESCRIPTION OF THE INVENTION

Figure 1:
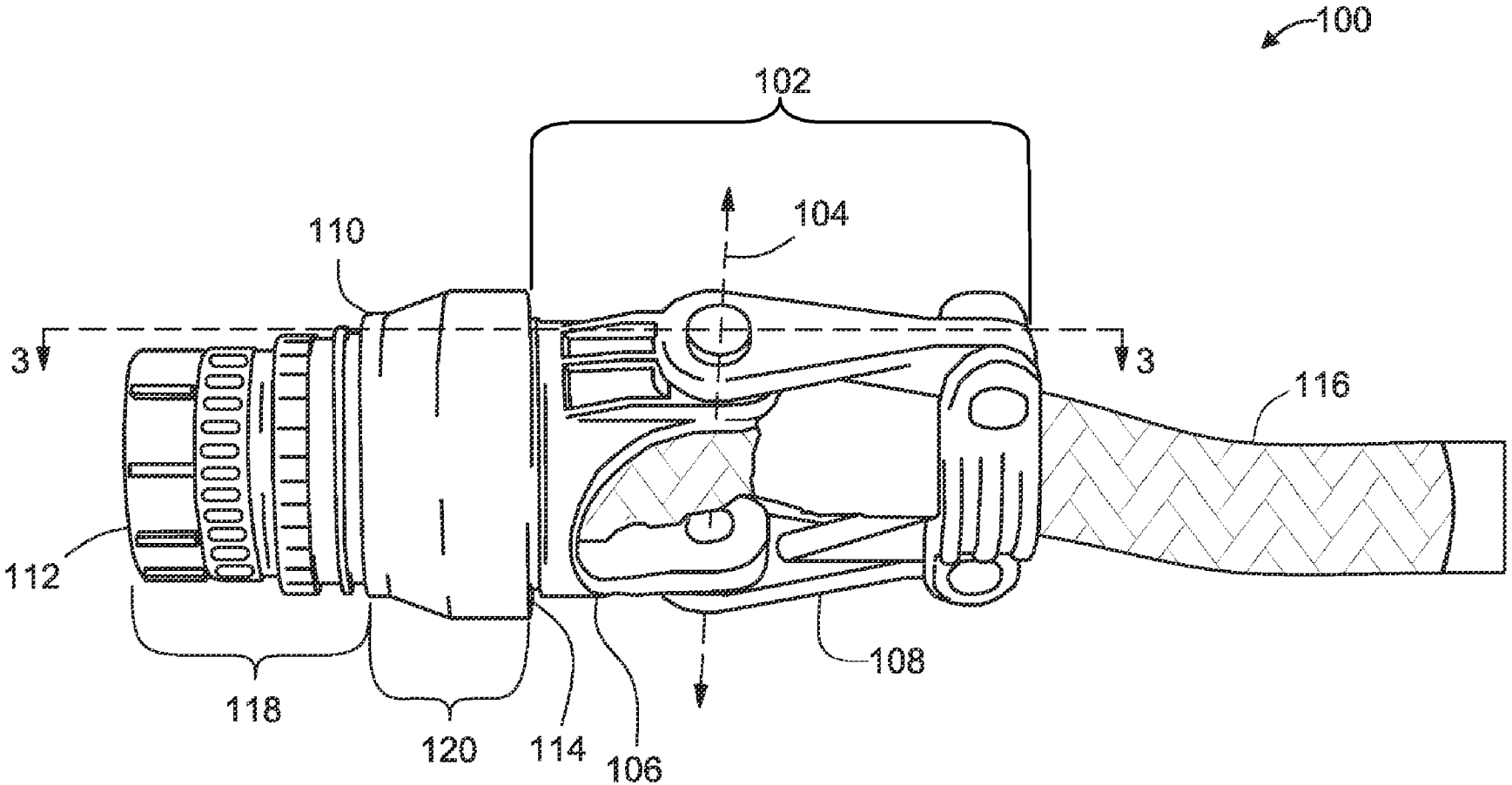
FIG. 1 is a perspective view of a connector assembly in accordance with one embodiment.

FIG. 1 is a perspective view of a connector assembly 100 in accordance with one embodiment. The connector assembly 100 may be a swing-arm connector. Alternatively, the connector assembly 100 may be a different type or style of connector. The connector assembly 100 couples with a mating connector (not shown) to electrically communicate data and/or power signals. The connector assembly 100 is an articulating connector in the illustrated embodiment. For example, the connector assembly 100 includes an articulating backshell 102 that pivots about a lateral axis 104. The backshell 102 includes a forward section 106 and a rear section 108 on opposite sides of the lateral axis 104. The forward and rear sections 106, 108 pivot relative to each other to articulate about the lateral axis 104 in order to permit the connector assembly 100 to be used in locations where space is limited.

For example, the rear section 108 may pivot such that the forward and rear sections 106, 108 are oriented at 45 or 90 degrees relative to each other.

The connector assembly 100 includes a housing 110 that extends from a mating end 112 to an opposite back end 114. The mating end 112 joins with a mating connector (not shown) to electrically couple the connector assembly 100 with the mating connector. The back end 114 is joined with the backshell 102. The housing 110 holds several contacts 302 (shown in FIG. 3) that are electrically coupled with conductors 300 (shown in FIG. 3). The conductors 300 may extend through insulated jackets 204 (shown in FIG. 2) that are held in a cable 116. In the illustrated embodiment, the cable 116 includes a braided jacket that encloses the insulated jackets 204 and the conductors 300. The cable 116 exits the housing 110 through the back end 114 and extends through the backshell 102. The backshell 102 holds the cable 116 such that, when the backshell 102 pivots about the lateral axis 104, the cable 116 bends at or near the lateral axis 104. For example, the cable 116 may bend such that the cable 116 follows the orientation of the rear section 108 of the backshell 102 relative to the forward section 106 of the backshell 102 and the housing 110.

In the illustrated embodiment, the housing 110 is a multi-part housing that includes an engagement section 118 and a coupling section 120. The engagement section 118 includes the mating end 112 and engages a mating connector (not shown) to electrically connect the connector assembly 100 with the mating connector. The coupling section 120 includes the back end 114 and secures the engagement section 118 with the backshell 102. The coupling section 120 may be a coupling nut, for example.

Figure 2:
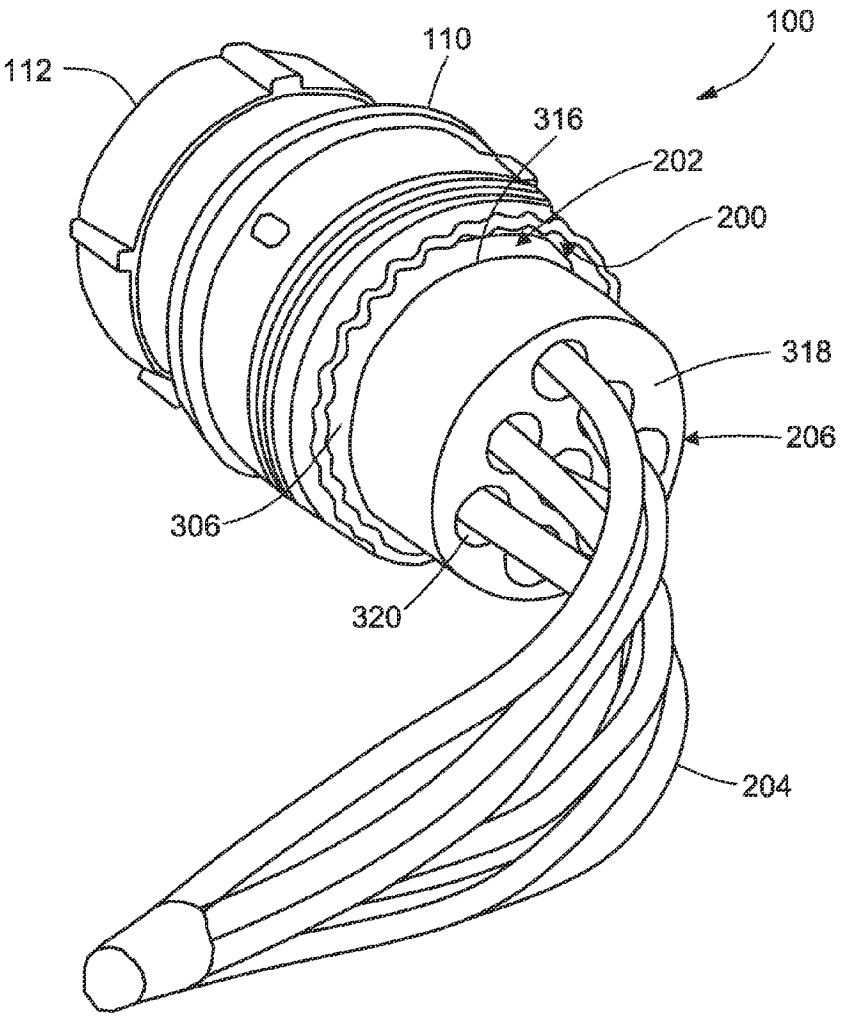
FIG. 2 is another view of the connector assembly shown in FIG. 1 in accordance with one embodiment.
Figure 3:
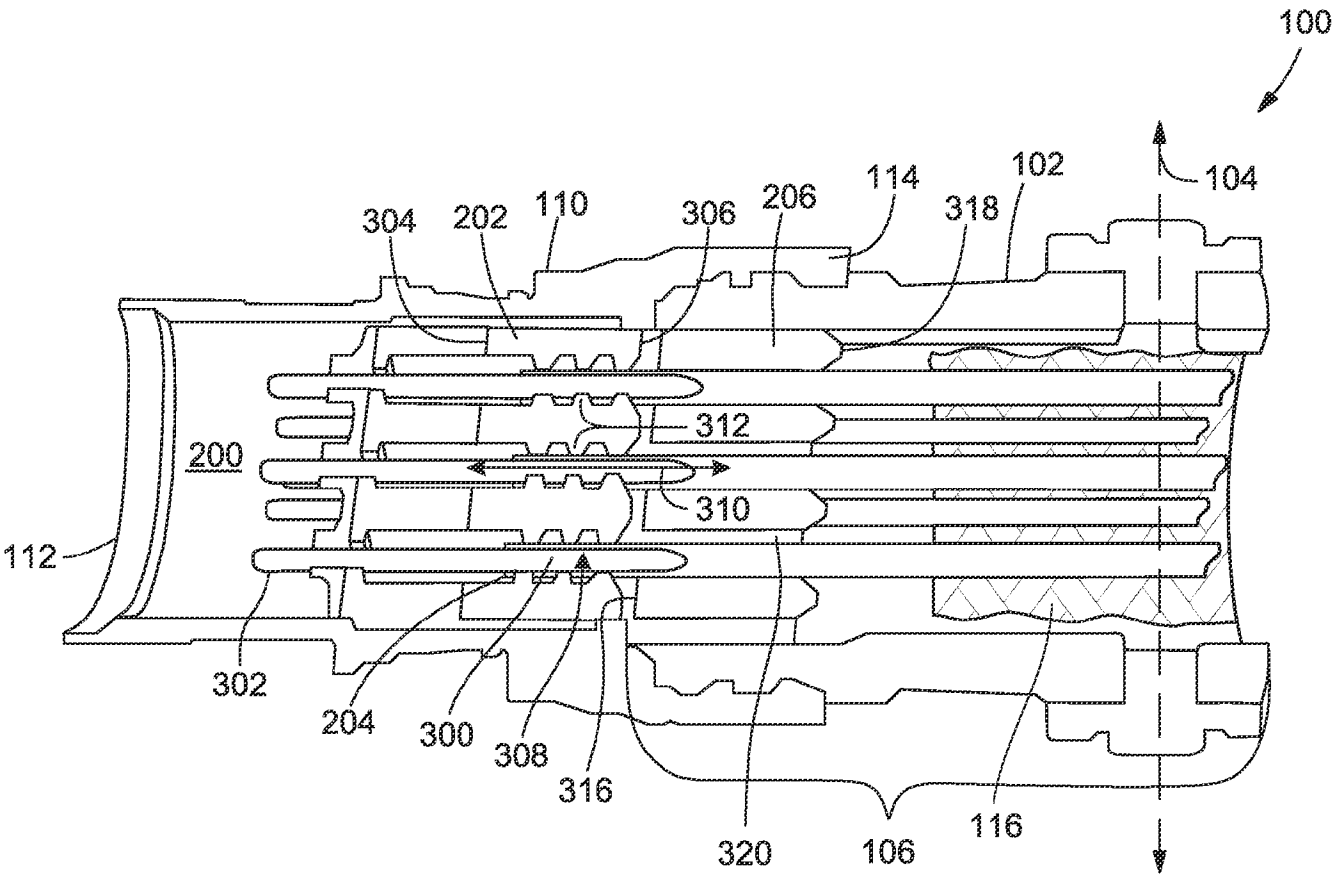
FIG. 3 is a cross-sectional view of the connector assembly shown in FIG. 1 along line 3-3 in FIG. 1 in accordance with one embodiment.

FIG. 2 is a view of the connector assembly 100 with the coupling section 120 and the backshell 102 shown in FIG. 1 removed in accordance with one embodiment. In the view shown in FIG. 2, the braided jacket of the cable 116 shown in FIG. 1 is removed. FIG. 3 is a cross-sectional view of the connector assembly 100 along line 3-3 in FIG. 1 in accordance with one embodiment. In the view shown in FIG. 3, the rear section 108 (shown in FIG. 1) of the backshell 102 is rotated about the lateral axis 104 such that the rear section 108 is perpendicularly oriented with respect to the forward section 106.

The housing 110 includes an interior chamber 200 that extends from the mating end 112 to the back end 114 (shown in FIGS. 1 and 3). A grommet 202 is disposed in the interior chamber 200. The grommet 202 is a body through which the conductors 300 (shown in FIG. 3) and the insulating jackets 204 that surround the conductors 300 extend. The grommet 202 extends between a forward end 304 (shown in FIG. 3) and an opposite cable exit end 306. The grommet 202 includes a plurality of openings 308 (shown in FIG. 3) that extend through the grommet 202. The openings 308 are oriented along center axes 310 (shown in FIG. 3) through the thickness of the grommet 202. The grommet 202 may be a unitary body or may be formed of two or more coupled discrete bodies.

As shown in FIG. 3, the conductors 300 are joined with contacts 302 that forwardly protrude from the grommet 202 in the interior chamber 200. For example, the contacts 302 project from the forward end 304 of the grommet 202 into an open volume of the interior chamber 200. The contacts 302 mate with conductive members (not shown) of a mating connector (not shown) that engages the connector assembly 100 at the mating end 112.

The conductors 300 (shown in FIG. 3) and insulating jackets 204 extend through the openings 308 in the grommet 202. The conductors 300 and insulating jackets 204 are generally aligned along the center axes 310 of the grommet 202 throughout the thickness of the grommet 202 in the illustrated embodiment. For example, the insulating jackets 204 may not have any significant bends away from the center axes 310 within the grommet 202.

The grommet 202 provides seals around the insulating jackets 204. The grommet 202 seals the insulating jackets 204 to prevent passage of moisture and/or other contaminants through the grommet 202 from the back end 114 (shown in FIGS. 1 and 3) of the housing 110 to the mating end 112 of the housing 110. For example, the grommet 202 includes glands 312 (shown in FIG. 3) that inwardly protrude into the openings 308 (shown in FIG. 3). The glands 312 are extensions of the grommet 202 that engage the insulating jackets 204 to seal the interfaces between the insulating jackets 204 and the grommet 202. As shown in FIG. 3, the glands 312 may engage the insulating jackets 204 around the peripheries of the insulating jackets 204 within the openings 308.

A cable organizer 206 is disposed proximate to the grommet 202 and is disposed in the interior chamber 200 of the housing 110 in the illustrated embodiment. For example, the cable organizer 206 may abut or otherwise engage the exit end 306 of the grommet 202. Alternatively, the cable organizer 206 may be disposed in the interior chamber 200 and coupled with the grommet 202, such as by one or more intervening components. In another embodiment, the cable organizer 206 is coupled with the housing 110 but is otherwise located outside of the interior chamber 200. For example, the cable organizer 206 may be joined with the back end 114 of the housing 110.

The cable organizer 206 may be a discrete body that is separate from the grommet 202. For example, the cable organizer 206 may be a unitary body that is separate from the grommet 202. The cable organizer 206 may be formed as a single body or formed as multiple bodies that are joined with each other. The cable organizer 206 extends between a front end 316 and an opposite back end 318. The front end 316 faces the exit end 306 of the grommet 202. In one embodiment, the front end 316 abuts the exit end 306. In another embodiment, the front end 316 is interconnected with the exit end 306. For example, an adhesive, potting compound, or other component may be disposed between the front end 316 and the exit end 306. In another example, the front end 316 and the exit end 306 may be spatially separated from each other. The back end 318 faces the backshell 102 (shown in FIGS. 1 and 3).

The backshell 102 may be coupled with the housing 110 through a threaded connection. For example, the backshell 102 may include threads on the outside of the backshell 102 and the housing 110 may include corresponding threads on the inside of the housing 110. The threads of the backshell 102 engage the housing 110 to secure the backshell 102 to the housing 110 in one embodiment. For example, the backshell 102 may be rotated, or torqued down, onto the housing 110 to secure the backshell 102 and housing 110 with each other. The torquing of the backshell 102 onto the housing 110 may provide a force on the cable organizer 206 that pushes or compresses the cable organizer 206 against the grommet 202.

Channels 320 extend through the cable organizer 206 from the front end 316 to the back end 318. The channels 320 may be aligned with the openings 308 (shown in FIG. 3) of the grommet 202. For example, the channels 320 and the openings 308 may be axially aligned along the center axes 310 (shown in FIG. 3). The conductors 300 (shown in FIG. 3) and the insulating jackets 204 extend through the channels 320.

For example, the conductors 300 and insulating jackets 204 may be aligned with the center axes 310 through the channels 320 and openings 308.

The cable organizer 206 keeps the insulating jackets 204 aligned with the openings 308 (shown in FIG. 3) in the grommet 202 to prevent leak paths from forming between the insulating jackets 204 and the grommet 202. A leak path may be a gap or spatial separation between the insulating jacket 204 and the grommet 202 within an opening 308 that permits moisture and/or other contaminants to pass through the opening 308 between the grommet 202 and the insulating jacket 204. The cable organizer 206 prevents leak paths from being introduced by stopping the insulating jackets 204 from significantly bending at or near the exit end 306 of the grommet 202. For example, the channels 320 limit movement of the insulating jackets 204 and the conductors 300 in directions that are obliquely or perpendicularly oriented with respect to the center axes 310 (shown in FIG. 3) as the insulating jackets 204 and the conductors 300 extend from the exit end 306 of the grommet 202. In one embodiment, the cable organizer 206 prevents the insulating jacket 204 and the conductors 300 from bending away from the center axes 310 between the forward end 304 of the grommet 202 and the back end 318 of the cable organizer 206. By keeping the insulating jackets 204 generally aligned with the center axes 310 of the openings 308 as the insulating jackets 204 extend from the exit end 306 of the grommet 202, the cable organizer 206 prevents leak paths from being introduced between the insulating jackets 204 and the grommet 202 at or near the exit end 306. The insulating jackets 204 may be generally aligned with the center axes 310 when the insulating jackets 204 are not bent in transverse or oblique directions at or near the exit end 306.

The cable organizer 206 prevents the insulating jackets 204 from bending at or near the exit end 306 of the grommet 202 even when the insulating jackets 204 are bent outside of the cable organizer 206. For example, when the backshell 102 (shown in FIGS. 1 and 3) bends about the lateral axis 104, as shown in FIG. 3, the insulating jackets 204 and conductors 300 inside the cable 116 (shown in FIGS. 1 and 3) also bend about the lateral axis 104 outside of the cable organizer 206. But, the cable organizer 206 permits the insulating jackets 204 to bend outside and away from the grommet 202, but prevents the insulating jackets 204 from bending at the exit end 306 of the grommet 202.

In the illustrated embodiment, the cable organizer 206 is a single body that encloses the channels 320. For example, the channels 320 are confined within the outer boundary or circumference of the cable organizer 206. Alternatively, one or more channels 320 may be disposed at an outer edge or the periphery of the cable organizer 206 such that the channels 320 are not enclosed by the outer boundary or periphery of the cable organizer 206.

Figure 4:
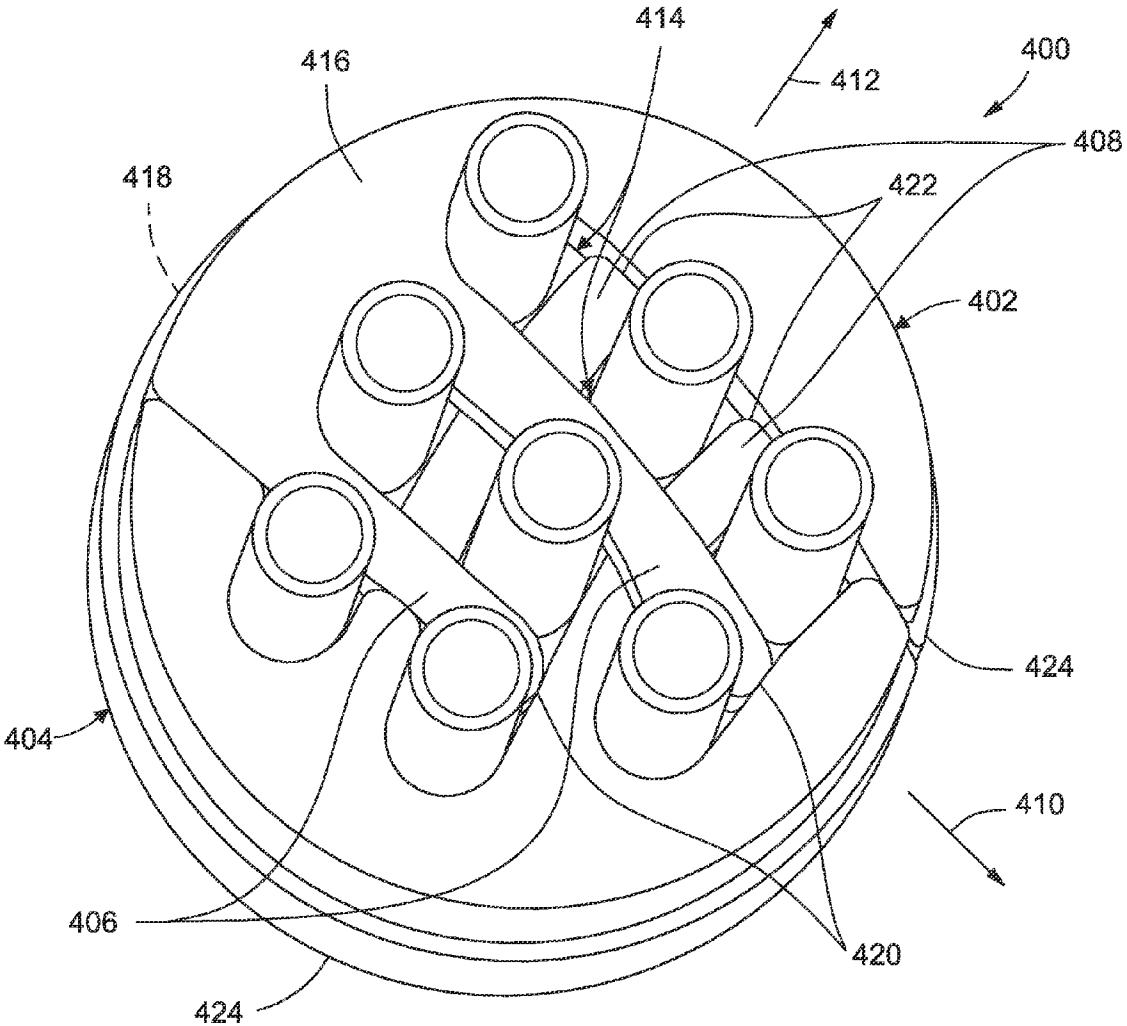
FIG. 4 is a perspective view of a cable organizer in accordance with another embodiment.

FIG. 4 is a perspective view of a cable organizer 400 in accordance with another embodiment. The cable organizer 400 may be used in conjunction with the connector assembly 100 (shown in FIG. 1). For example, the cable organizer 400 may be used in place of or in addition to the cable organizer 206 (shown in FIG. 2). The cable organizer 400 includes a plurality of cable separator bodies 402, 404 that are discrete bodies and that are separate from each other in the illustrated embodiment. While only two bodies 402, 404 are shown, alternatively a greater number of bodies may be included in the cable organizer 400. The bodies 402, 404 include a radially protruding ridge 424 that extends away from the bodies 402, 404. The ridge 424 locally increases the size of the bodies 402, 404. For example, the outer diameter or size of the periphery of the bodies 402, 404 at the ridge 424 may be larger than the outer diameter or size of the periphery of the bodies 402, 404 away from the ridge 424. The ridge 424 may engage the housing 110 (shown in FIG. 1) inside the interior chamber 200 (shown in FIG. 2) to provide an interference fit between the cable organizer 400 and the housing 110. The interference fit may secure the cable organizer 400 within the housing 110.

Each of the bodies 402, 404 includes elongated beams 406, 408. The beams 406, 408 overlap each other. For example, when the bodies, 402, 404 are joined together, the beams 406 of the body 402 extend over and overlap the beams 408 of the body 404. The beams 406, 408 extend from the bodies 402, 404 to outer ends 420, 422 in different directions 410, 412. The beams 406 generally protrude from the body 402 along a first direction 410 while the beams 408 generally project from the body 404 along a second direction 412 that is angled with respect to the first direction 410. In the illustrated embodiment, the first and second directions 410, 412 are approximately perpendicular with respect to each other. Alternatively, the first and second directions 410, 412 may be obliquely oriented with respect to each other.

The ends 420 of the beams 406 of the body 402 engage the body 404 while the ends 422 of the beams 408 of the body 404 engage the body 402 in the illustrated embodiment. For example, the ends 420 may abut the body 404 while the ends 422 abut the body 402.

The beams 406 extend across, or overlie, the beams 408. The overlapping beams 406, 408 form channels 414 that extend through the cable organizer 400. For example, similar to the channels 320 (shown in FIG. 3), the beams 406, 406 create channels 414 that also extend through the thickness of the cable organizer 400, or between opposite ends 416, 418 of the cable organizer 400. The insulating jackets 204 and conductors 300 are disposed in the channels 414 through the cable organizer 400.

Figure 5:
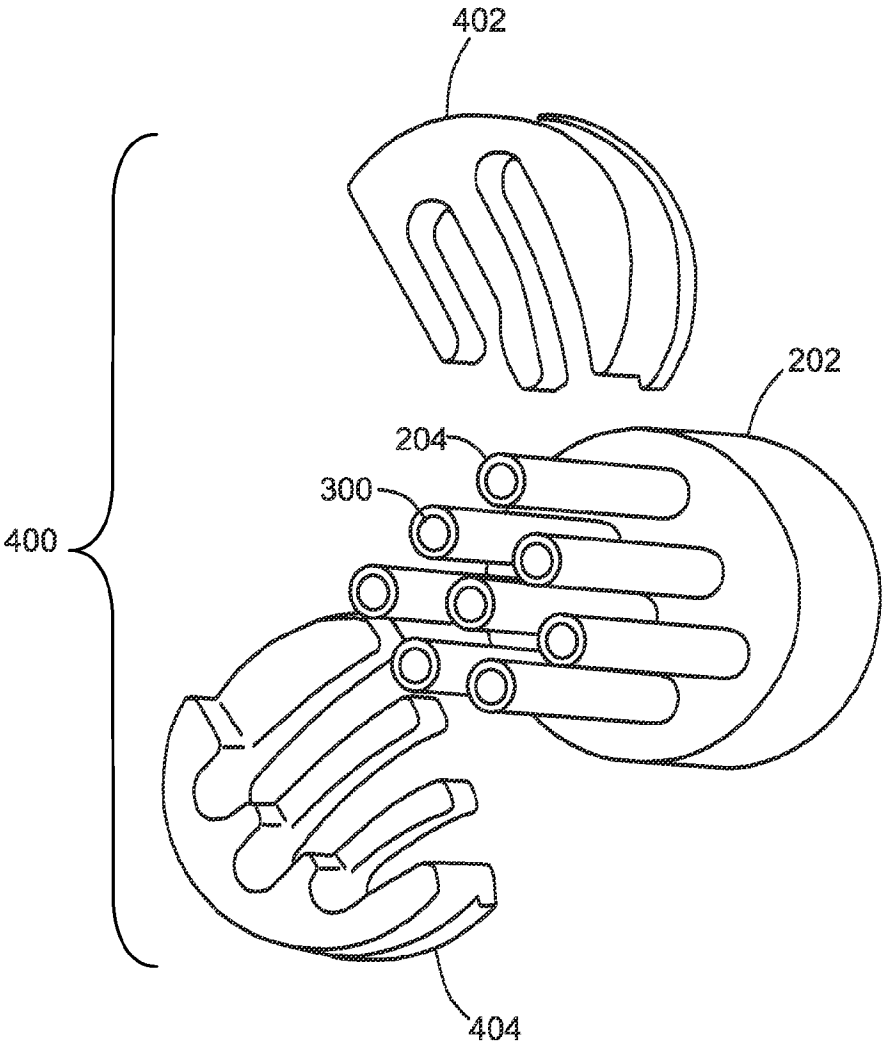
FIG. 5 is an exploded view of the cable organizer shown in FIG. 4 in accordance with one embodiment.

FIG. 5 is an exploded view of the cable organizer 400 in accordance with one embodiment. The division of the cable organizer 400 into multiple bodies 402, 404 permits the cable organizer 400 to be assembled to the insulating jackets 204 and conductors 300 of the cable 116 (shown in FIG. 1) after the insulating jackets 204 and conductors 300 are threaded through the grommet 202 and/or the grommet 202 is inserted into the housing 110 (shown in FIG. 1). For example, the cable organizer 400 may be retrofitted or added to a connector assembly that is similar to the connector assembly 100 but that does not include any cable organizer.

Figure 6:
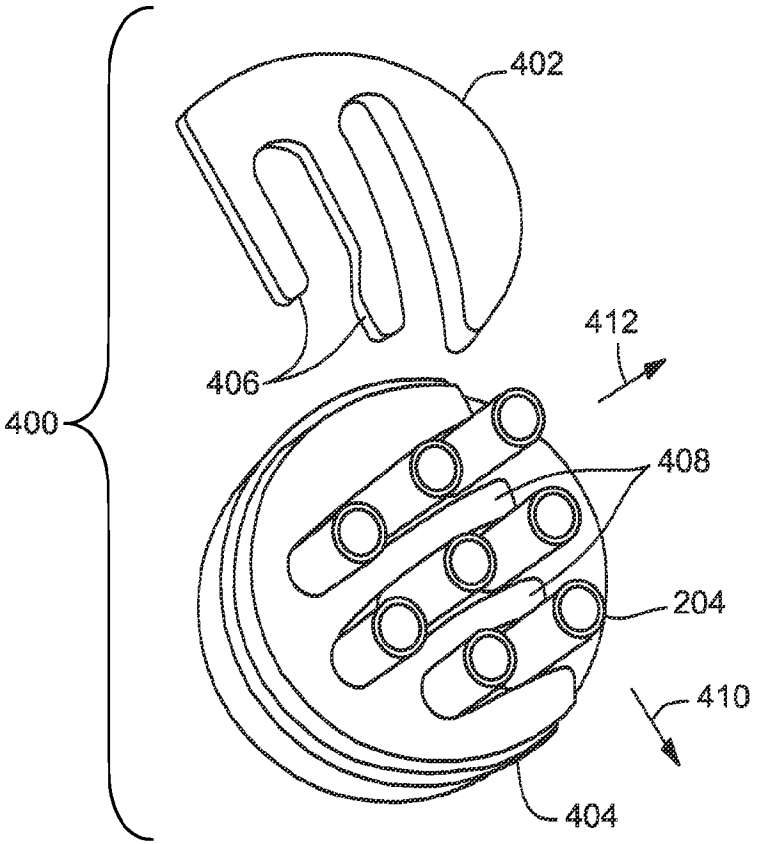
FIG. 6 is another exploded view of the cable organizer shown in FIG. 4 in accordance with one embodiment.

FIG. 6 is another exploded view of the cable organizer 400 in accordance with the embodiment shown in FIG. 5. In order to assemble the cable organizer 400, the beams 408 of the body 404 are inserted between the insulating jackets 204. For example, the beams 408 may be threaded between the insulating jackets 204 that neighbor each other or are adjacent to each other along the first direction 410. As shown in FIG. 5, the beams 408 do not separate the insulating jackets 204 that are adjacent to each other along the second direction 412, or along the direction of elongation of the beams 408.

After the beams 408 are placed between the insulating jackets 204, the beams 406 of the body 402 are inserted between the insulating jackets 204. For example, the beams 406 may be threaded between the insulating jackets 204 that neighbor or are adjacent to each other along the second direction 412. The beams 406 may not separate the insulating jackets 204 that are adjacent to each other along the first direction 410, or along the direction of elongation of the beams 406. While the embodiment shown in FIGS. 5 and 6 shows the beams 408 of the body 404 being threaded between the insulating jackets 204 prior to the beams 406 of the body 402, alternatively the beams 406 of the body 402 may be threaded between the insulating jackets 204 prior to the beams 408 of the body 404.

Figure 7:
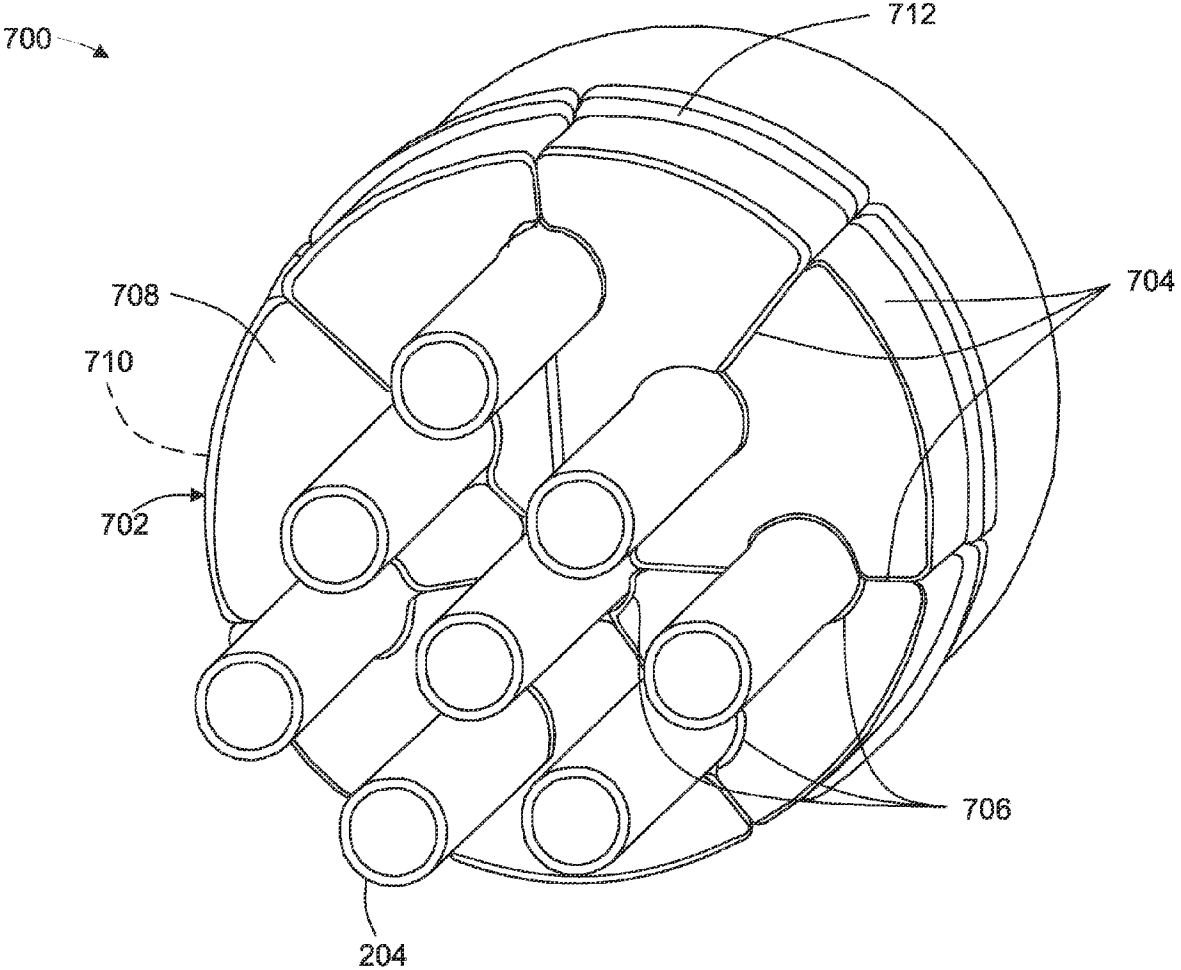
FIG. 7 is a perspective view of a cable organizer in accordance with another embodiment.
Figure 8:
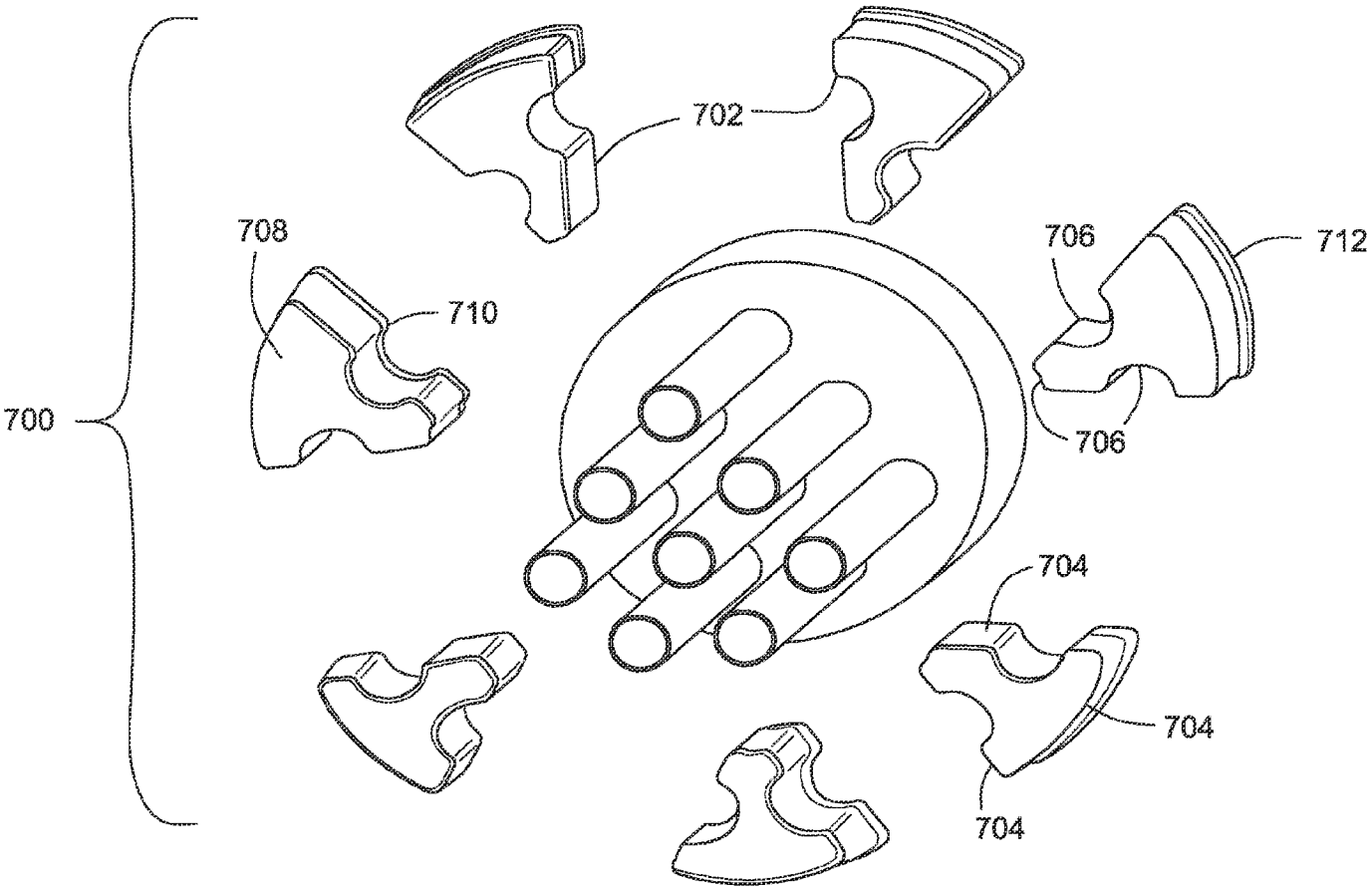
FIG. 8 is an exploded view of the cable organizer shown in FIG. 7 in accordance with one embodiment.

FIG. 7 is a perspective view of a cable organizer 700 in accordance with another embodiment. FIG. 8 is an exploded view of the cable organizer 700. The cable organizer 700 may be used in conjunction with the connector assembly 100 (shown in FIG. 1). For example, the cable organizer 700 may be used in place of or in addition to the cable organizer 206 (shown in FIG. 2). The cable organizer 700 includes a plurality of cable separator bodies 702 that are discrete bodies and that are separate from each other in the illustrated embodiment. While only seven bodies 702 are shown, alternatively a smaller or greater number of bodies may be included in the cable organizer 700. Additionally, while the bodies 702 are shown as pie-shaped pieces, the bodies 702 may have a different shape.

The bodies 702 include a radially protruding ridge 712 that extends away from the bodies 702. The ridge 712 locally increases the size of the bodies 702. For example, the outer diameter or size of the periphery of the bodies 702 at the ridge 712 may be larger than the outer diameter or size of the periphery of the bodies 702 away from the ridge 712. The ridge 712 may engage the housing 110 (shown in FIG. 1) inside the interior chamber 200 (shown in FIG. 2) to provide an interference fit between the cable organizer 700 and the housing 110. The interference fit may secure the cable organizer 700 within the housing 110.

Each of the bodies 702 is bounded by intersecting outer edges 704. In the illustrated embodiment, the outer edges 704 define an approximately triangular-shaped body. Alternatively, the outer edges 704 may define a different shape. Each of the bodies 702 includes recesses 706 that extend through the thickness of the cable organizer 700. For example, the recesses 706 may be voids that extend into the body 702 from the outer edges 704 of the body 702. In the illustrated embodiment, the recesses 706 are approximately semi-circular voids that extend into two of the outer edges 704 that intersect each other. While one recess 706 extends into each of the outer edges 704 that intersect each other, a different number of recesses 706 may extend into the intersecting outer edges 704. For example, two or more recesses 706 may extend into one or more of the intersecting outer edges 704. Alternatively, one of the two intersecting outer edges 704 may not include a recess 706. In the illustrated embodiment, the recesses 706 also are located at the intersection of two of the outer edges 704. For example, the intersecting outer edges 704 that include the recesses 706 may have an additional recess 706 positioned at the point of intersection of the outer edges 704.

The bodies 702 are placed between neighboring or adjacent insulating jackets 204 to separate the insulating jackets 204. The bodies 702 are placed between the insulating jackets 204 such that the recesses 706 of neighboring bodies 702 at least partially extend around outer peripheries of the insulating jackets 204. For example, the recesses 706 of adjacent bodies 702 may be positioned such that the recesses form channels that extend through the thickness of the cable organizer 700, or between opposite ends 708, 710 of the cable organizer 700.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing including an interior chamber;

a grommet disposed in the interior chamber of the housing, the grommet extending between a forward end and an exit end, the grommet including openings extending through the grommet with insulated conductors extending through the openings and joined with contacts such that the contacts project from the forward end;

a cable organizer disposed proximate to the grommet, the cable organizer including channels extending along center axes through the cable organizer with the insulated conductors extending through the channels; and an articulating backshell coupled to the housing, the cable organizer being located between the backshell and the grommet, the backshell being configured to hold and bend the insulated conductors at or near a lateral axis that extends substantially perpendicular to the center axes, wherein the cable organizer limits bending by the insulated conductors at the exit end of the grommet when the insulated conductors are bent at or near the lateral axis.

2. The connector assembly of claim 1, wherein the openings of the grommet and the channels of the cable organizer are axially aligned with each other.

3. The connector assembly of claim 1, wherein the grommet engages the insulated conductors to seal leak paths between the insulated conductors and the grommet within the openings, the cable organizer maintaining seals on the leak paths by limiting bending by the insulated conductors at the exit end of the grommet.

4. The connector assembly of claim 1, wherein the cable organizer extends from a front end that faces the exit end of the grommet to an opposite back end, the grommet and the cable organizer limiting bending by the insulated conductors between the forward end of the grommet and the back end of the cable organizer.

5. The connector assembly of claim 1, wherein the grommet and the cable organizer are discrete bodies.

6. The connector assembly of claim 1, further comprising a cable that includes the insulated conductors, the backshell including forward and rear sections on opposite sides of the lateral axis, wherein the forward and rear sections are coupled to each other and configured to pivot relative to each other to bend the cable at or near the lateral axis.

7. A connector assembly comprising:

a housing including an interior chamber;

a grommet disposed in the interior chamber of the housing, the grommet extending between a forward end and an exit end, the grommet including openings extending through the grommet with insulated conductors extending through the openings and joined with contacts such that the contacts project from the forward end; and a cable organizer disposed proximate to the grommet, the cable organizer including channels extending through the cable organizer with the insulated conductors extending through the channels, the cable organizer limiting bending by the insulated conductors at the exit end of the grommet, wherein the cable organizer includes a plurality of discrete cable separator bodies that separate the insulated conductors from each other.

8. The connector assembly of claim 7, wherein the cable separator bodies include first and second cable separator bodies that each have elongated beams, the elongated beams separating the insulated conductors from each other.

9. The connector assembly of claim 8, wherein the elongated beams of the first cable separator body separate the insulated conductors from each other in a first direction and the elongated beams of the second cable separator body separate the insulated conductors from each other in a different second direction.

10. The connector assembly of claim 8, wherein the elongated beams of the first and second cable separator bodies overlap to form the channels of the cable organizer.

11. The connector assembly of claim 7, wherein the cable separator bodies include recesses that define the channels when the cable separator bodies engage each other.

12. The connector assembly of claim 11, wherein the cable separator bodies include recesses along outer edges of the cable separator bodies with the insulated conductors extending through the cutouts of adjacent cable separator bodies.

13. A connector assembly comprising:

a housing including an interior chamber;

a grommet disposed in the interior chamber of the housing, the grommet extending between a forward end and an opposite exit end, the grommet including openings extending therethrough with insulated conductors extending through the openings and joined with contacts such that the contacts project from the forward end; and a cable organizer disposed proximate to the grommet, the cable organizer including first and second cable separator bodies each having elongated beams oriented in different directions, the beams forming channels extending through the cable organizer with the insulated conductors extending through the channels, the cable organizer limiting bending by the insulated conductors at the exit end of the grommet.

14. The connector assembly of claim 13, wherein the elongated beams of the first cable separator body separate the insulated conductors from each other along a first direction and the elongated beams of the second cable separator body separate the insulated conductors from each other along a different second direction.

15. The connector assembly of claim 13, wherein the elongated beams of the first cable separator body separate the insulated conductors from each other in a first direction and the elongated beams of the second cable separator body separate the insulated conductors from each other in a different second direction.

16. A connector assembly comprising:

a housing including an interior chamber;

a grommet disposed in the interior chamber of the housing, the grommet extending between a forward end and an opposite exit end, the grommet including openings extending therethrough with insulated conductors extending through the openings and joined with contacts such that the contacts project from the forward end; and a cable organizer disposed proximate to the grommet and including a plurality of discrete cable separator bodies that include recesses disposed on outer sides of the cable separator bodies, the cable separator bodies receiving the insulated conductors in the recesses of neighboring cable separator bodies and limiting bending by the insulated conductors at the exit end of the grommet.

17. The connector assembly of claim 16, wherein the recesses of the cable separator bodies define channels that the insulated conductors extend through in the cable organizer.

18. The connector assembly of claim 16, wherein the recesses of the cable separator bodies include voids extending into outer edges of the cable separator bodies with the insulated conductors extending into the recesses of adjacent cable separator bodies.

19. The connector assembly of claim 16, wherein the recesses surround the insulated conductors when the cable separator bodies engage each other.

20. The connector assembly of claim 19, wherein the recesses extend entirely through the cable separator bodies.

* * * * *